US010088241B1

(12) United States Patent
Meissner

(10) Patent No.: US 10,088,241 B1
(45) Date of Patent: Oct. 2, 2018

(54) MULTI-MODE HEAT EXCHANGE SYSTEM FOR SENSIBLE AND/OR LATENT THERMAL MANAGEMENT

(71) Applicant: Alan P. Meissner, Franklin, WI (US)

(72) Inventor: Alan P. Meissner, Franklin, WI (US)

(73) Assignee: Engendren Corporation, Kenosha, WI (US)

( * ) Notice: Subject to any disclaimer, the term of this patent is extended or adjusted under 35 U.S.C. 154(b) by 678 days.

(21) Appl. No.: 13/843,239

(22) Filed: Mar. 15, 2013

Related U.S. Application Data

(60) Provisional application No. 61/647,669, filed on May 16, 2012.

(51) Int. Cl.

| | |
|---|---|
| ***F28F 27/00*** | (2006.01) |
| ***F24F 3/14*** | (2006.01) |
| ***F25B 49/00*** | (2006.01) |
| ***F28D 15/00*** | (2006.01) |

(52) U.S. Cl.
CPC ..... *F28D 15/00* (2013.01)

(58) Field of Classification Search
CPC . F24F 13/222; F24F 2013/227; F28D 1/0475; F28D 2021/0038; F28D 2003/1452; F28D 1/0408; F28F 3/153; F28F 3/1405; F28F 2003/144; F28F 2003/1446
USPC ..... 62/90, 176.5, 173; 165/176, 200, 222
See application file for complete search history.

(56) References Cited

U.S. PATENT DOCUMENTS 2,107,243 A * 2/1938 Gay ..... 62/173
3,921,413 A * 11/1975 Kohlbeck ..... 62/173
4,098,854 A * 7/1978 Knirsch et al. ..... 261/161
5,309,725 A * 5/1994 Cayce ..... 62/90
5,666,813 A 9/1997 Brune
5,799,728 A * 9/1998 Blume ..... 165/231
5,953,926 A 9/1999 Dressler et al.
6,321,558 B1 11/2001 Pruse
6,595,012 B2 * 7/2003 Rafalovich ..... 62/92
7,059,151 B2 6/2006 Taras et al.
(Continued)

OTHER PUBLICATIONS

Tom Brooke, PE, CEM, Neutral Air Units With Heat Pipes in Chilled Water Systems, Apr. 2007, Heat Pipe Technology, Inc. (10 pages).

(Continued)

*Primary Examiner* — Jason Thompson
(74) *Attorney, Agent, or Firm* — Brannen Law Office, LLC

(57) ABSTRACT

The present invention relates to a multi-mode thermal management assembly with a selectable coolant flow path, and in particular to an assembly that selectably removes latent and/or sensible heat. Coolant (working fluid) is routed through openings in the bottom of the thermal management assembly. The assembly can have two heat exchangers (coolers), each having side-by-side vertical paths whereby coolant both enters and exits from the heat exchangers at their respective bottoms. Plumbing is provided that can be selected to route coolant for one of the user selected cooling modes. Valves allow the user to select at least between a combination mode (latent cooling with sensible reheat) and a sensible only cooling mode. In the combination mode, the latent heat exchanger cools and dehumidifies, and the sensible heat exchanger partially reheats the air while requiring no additional work to be done on the system by external power consuming devices.

7 Claims, 6 Drawing Sheets

(56) References Cited

U.S. PATENT DOCUMENTS

| | | | | |
|---|---|---|---|---|
| 7,770,405 | B1 * | 8/2010 | Dillon | 62/176.5 |
| 2003/0131611 | A1 * | 7/2003 | Oshitani et al. | 62/90 |
| 2006/0288713 | A1 * | 12/2006 | Knight et al. | 62/176.6 |
| 2008/0230215 | A1 * | 9/2008 | Auchter | F28D 1/05391 165/176 |
| 2012/0012285 | A1 * | 1/2012 | Okamoto | F24F 3/153 165/110 |

OTHER PUBLICATIONS

Author—Unknown. Title—Unknown. Article regarding runaround coils. (7 pages).

* cited by examiner

MULTI-MODE HEAT EXCHANGE SYSTEM FOR SENSIBLE AND/OR LATENT THERMAL MANAGEMENT

This United States utility patent application claims priority on and the benefit of provisional application 61/647,669 filed May 16, 2012, the entire contents of which are hereby incorporated herein by reference.

BACKGROUND OF THE INVENTION

1. Field of the Invention

The present invention relates to a multi-mode heat exchange assembly with a selectable coolant flow path, and in particular to a multi-mode assembly for sensible and/or latent thermal management.

2. Description of the Related Art

It is desirable to control the environmental conditions within a structure for many reasons. Some reasons include comfort of people within the structure and the desired environmental conditions for equipment housed within the structure. Desired environment conditions include not only temperature, but also absolute humidity.

Cooling an environment provides a challenge in that environmental air includes both sensible and latent energy. The dry bulb temperature may change while sensibly cooling, but the absolute humidity ratio (lb vapor/lb dry air) does not appreciably decrease. To the contrary, latent cooling is useful to reduce both the temperature and the absolute humidity ratio within the air.

One example of a system designed to supply outside air is described in a publication by Heat Pipe Technology, Inc. titled "Neutral Air Units With Heat Pipes In Chilled Water Systems." While this system may work well for its intended purposes, it nevertheless is unsuitable for the purposes of the present invention. Specifically, this system utilizes a working fluid that undergoes phase change during operation. The phase change is dependent upon vaporizing and condensing; thereby limiting operational ranges of the system. It also requires additional energy to produce the phase change. It further requires a large foot print, is not scalable, is complicated and could be designed to be more efficient.

Thus there exists a need for a multi-mode thermal management system that solves these and other problems.

SUMMARY OF THE INVENTION

The present invention relates to a multi-mode thermal management assembly with a selectable coolant flow path, and in particular to an assembly that selectably removes latent and/or sensible heat. Coolant (working fluid) is supplied to and returned through openings in the bottom of the thermal management assembly. The assembly can have two heat exchangers (coolers), each having side-by-side vertical paths whereby coolant both enters and exits from the heat exchanger at the bottom of the respective heat exchangers. Plumbing is provided that can be selected to route coolant for one of the user selected cooling modes. Valves allow the user to select at least between a combination mode (latent cooling with sensible reheat) and a sensible only cooling mode. In the combination mode, the latent heat exchanger cools and dehumidifies, and the sensible heat exchanger partially reheats the air while requiring no additional work to be done on the system by external power consuming devices.

There are several advantages related to the geometry of the present invention.

According to one advantage of the present invention, the routing of the working fluid can be routed in a counter-flow orientation in each heat exchanger. This advantageously allows for an appropriate temperature differential (between the working fluid and the air) on each side of the heat exchanger.

According to another advantage of the present invention, the two heat exchangers of the thermal management assembly can be located in a series arrangement relative to the air flow path (external fluid path). In a preferred coolant flow path of the combination mode, the first heat exchanger can remove latent heat, and the second heat exchanger can use the heated working fluid (after it exits the first heat exchanger) to sensibly reheat the air to a desired temperature. This can be accomplished because of the counter-flow path in the heat exchangers (specifically the first heat exchanger). In such an arrangement of the first heat exchanger, the coolant is cooler in the rear path and warmer in the front path (because it gains heat in the first pass). Hence, the temperature of the fluid exiting the front path of the latent heat exchanger is warmer than the air that is exiting from the first heat exchanger. This warmer fluid is then used to reheat the air as it passes through the second heat exchanger. This is advantageously accomplished without adding additional energy to the system.

According to further advantage of the present invention, the thermal management assembly is readily adapted to a structure (stationary or mobile) housing electronics. In this regard, the working fluid is supplied to and returned from the thermal management assembly at the bottom of the structure, whereby any leaks in the plumbing will be contained below the electronics, thereby preventing damage of the electronics.

According to a still further advantage, the thermal management assembly has a small foot print. In this regard, the thermal management assembly can be located in areas that are too small to locate previous cooling assemblies.

Related, and according to a still further advantage of the present invention, the thermal management assembly is readily scalable. In this regard, the thermal management assembly can contain more than one thermal management module. Also, as an alternative embodiment, the surface areas of the heat exchangers could be altered wherein a different selected amount of heat transfer can occur.

According to a still further advantage yet of the present invention, flow control valves can be provided to allow the operator to select and switch at least between a sensible only thermal management mode (FIG. 6) and a combination thermal management mode (FIG. 5) based on environmental conditions. In a further embodiment, it is understood that the present invention could be configured for a latent only cooling mode.

An optional coalescing screen can be provided between the two heat exchangers of the present invention to ensure that any airborne liquid condensate is collected and removed from the system.

There are also several advantages related to the mechanics of the working fluid of the present invention.

According to a one such advantage, the operator can vary the rate of latent and sensible heat removal. This advantageously is accomplished by allowing the operator to control the entering temperature differential (ETD) of the operator specified coolant resulting in selected comfort and environmental conditions within the structure.

In one embodiment, water is preferably used as a coolant and accordingly a flexible condensate setting is advantageously provided. The setting covers a wide range from 32 degrees Fahrenheit up to a reasonable limit. The temperature setting can be a function of the external device (i.e. chiller, economizer, dry heat exchanger, dx heat exchanger).

According to a still further advantage of the present invention, the system is non-complicated and has few working parts.

According to a still further advantage yet of the present invention, the working fluid operates in a single phase state (i.e. does not undergo a phase change during operation), is non-toxic and is commonly available.

According to another advantage of the present invention, a system utilizing the present invention can be designed and oriented for free or forced convection.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
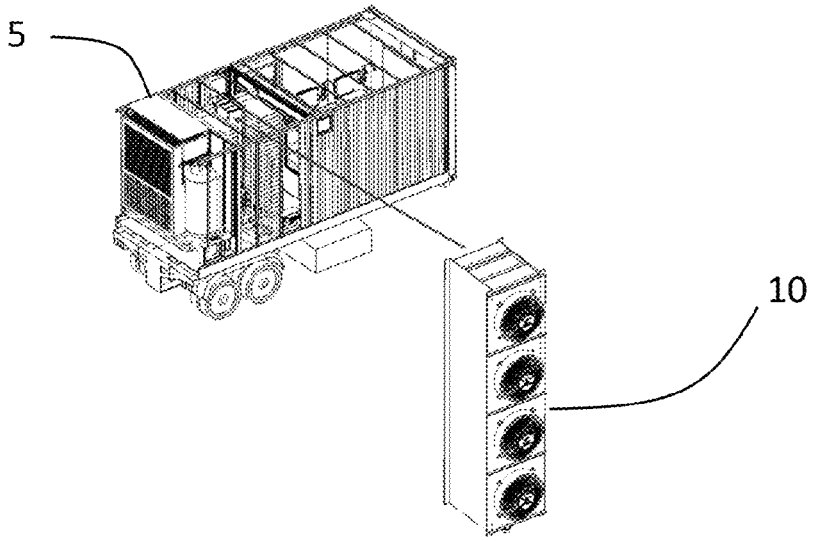
FIG. 1 is a view of one preferred environment (a mobile environment) in which the present invention is useful.
Figure 2:
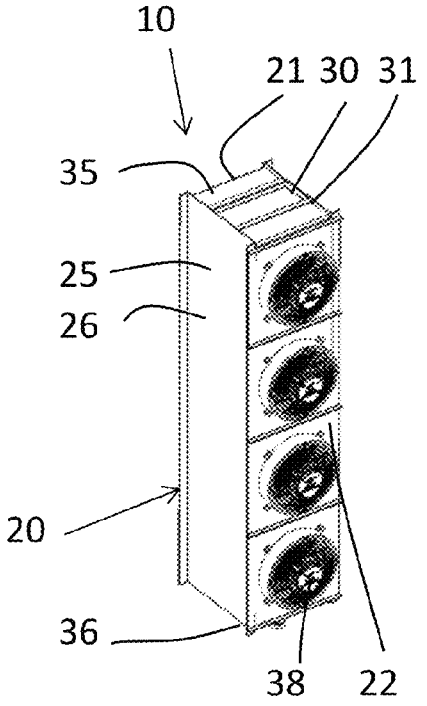
FIG. 2 is perspective view of a preferred thermal management module of the present invention.
Figure 3:
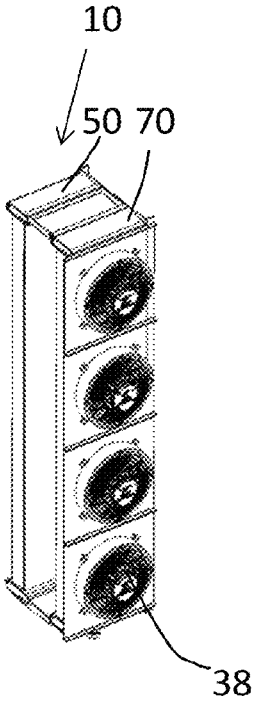
FIG. 3 is similar to FIG. 2, but is illustrated with a side panel removed.
Figure 4:
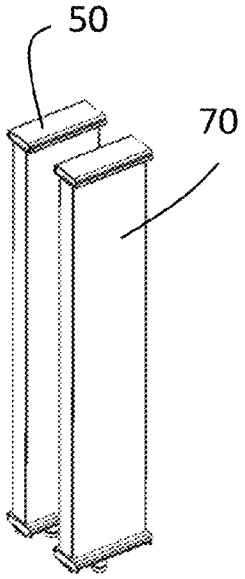
FIG. 4 is similar to FIG. 3, but shows the two heat exchangers of the preferred embodiment in isolation.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Looking now at FIGS. 1-10, it is seen that a first preferred embodiment is illustrated. A thermal management assembly 10 is provided for use in a structure 5. The illustrated structure 5 is a movable portable electronic center. However, it is understood that this is just one environment in which the present invention is useful. The present invention may be used in other environments (both stationary and mobile structures) without departing from the broad aspects of the present invention.

The thermal management assembly 10 can be made of one or more thermal management modules 20 (or simply modules). It is also understood that while relative dimensions are illustrated, that other dimensions (including surface areas and foot prints) may be altered without departing from the broad aspects of the present invention. In this regard, the thermal management assembly 10 is both modular and scalable.

Each module 20 has an opposed inlet and exit 21 and 22. A first side 25 with a side panel 26 is provided. A second side 30 with a side panel 31 is also provided. The cooling module 20 has both a top 35 and a bottom 36. One or more air movers 38, preferably fans, are provided. The fans can be mounted to, fixed relative or located adjacent end 22. In the preferred embodiment, there is a bank of four vertically stacked fans adjacent end 22. Yet, more or fewer fans could be used without departing from the broad aspects of the present invention. It is seen that the module 20 is illustrated having a general box shape that has a relatively small foot print and that is relatively tall in relation to its depth and width dimension. While this is a preferred embodiment, the dimensions may nevertheless be changed without departing from the broad aspects of the present invention. The air movers 38 preferably cause air to move in an air flow path 39.

It is appreciated that while the special orientations such as top and bottom are described herein, that the invention can be arranged or oriented differently without departing from the broad aspects of the present invention. Specifically, it is understood that the unit can be arranged horizontally allowing for free convection wherein the air flow path is generally vertical, or arranged in any orientation for a forced convective arrangement.

The thermal management module 20 preferably has two heat exchangers 50 and 70, respectively. Heat exchangers 50 and 70 are preferably arranged in a series arrangement relative the air flow path 39, and each is described below.

Heat exchanger 50 has faces 51 and 52, top 53 and bottom 54. Two internal flow paths 55 and 56 are provided. The paths preferably are vertically oriented, with path 55 spanning between the bottom 54 and top 53 along the second face 52 (back or trailing face relative air flow path 39), and path 56 spanning between the top 53 and bottom 54 along the first face 51 (front or leading face). An opening 57 is provided and allows for a working fluid to enter path 55. The top of paths 55 and 56 are preferably fluidly connected. Another opening 58 is also provided and allows for the working fluid to exit path 56.

Heat exchanger 70 has faces 71 and 72, top 73 and bottom 74. Two internal flow paths 75 and 76 are provided. The paths preferably are vertically oriented, with path 75 spanning between the bottom 74 and top 73 along the second face 72 (back or trailing face relative air flow path 39), and path 76 spanning between the top 73 and bottom 74 along the first face 71 (front or leading face). An opening 77 is provided and allows for a working fluid to enter path 75. The top of paths 75 and 76 are preferably fluidly connected. Another opening 78 is also provided and allows for the working fluid to exit path 76.

Plumbing 90 is further provided, and has a supply line 91, a return line 92, a cross heat exchanger line 93 and one or more valves 94. The valves 94 allow the operator to vary the routing of the working fluid through the thermal management module 20. While valves are described as a preferred embodiment, it is appreciated that other flow control devices may be used without departing from the broad aspects of the present invention.

Figure 7:
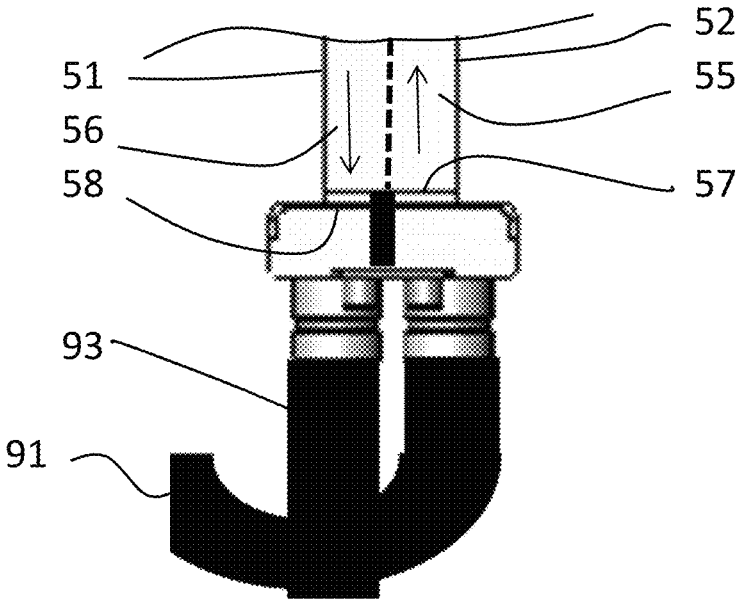
FIG. 7 is close-up side view showing two faces of a heat exchanger.

An example of a counter-flow configuration is illustrated in FIG. 7. The heat exchanger 50 has a header at its bottom. The header has an internal baffle or separator that divides the header into two regions, wherein opening 57 is in the first region and opening 58 is in the second region. Fluid can be piped in to opening 57 via supply line 92, rise up path 55 and then come down path 56. The fluid is coldest in path 57, and warmer in path 56. Fluid then exits the heat exchanger 50 through opening 58, wherein it can be routed to heat exchanger 70.

Figure 5:
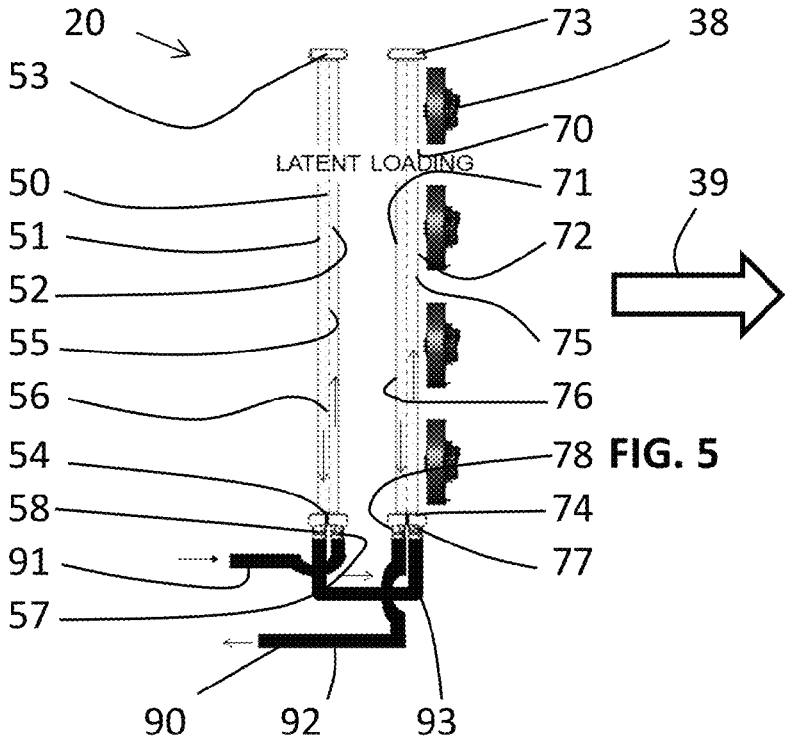
FIG. 5 is a side view of preferred heat exchangers of the present invention illustrating routing for a combination mode (latent heat removal with sensible reheat).
Figures 9, 10:
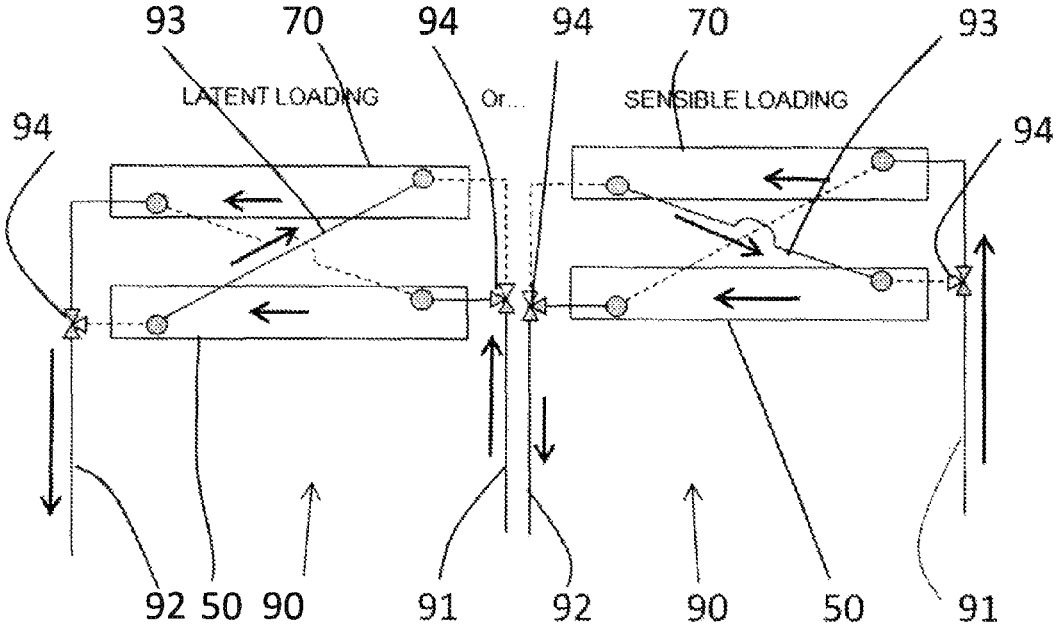
FIG. 9 is a controls schematic view showing the heat exchangers configured for the combination mode.
FIG. 10 is a controls schematic similar to FIG. 9, but shows the heat exchangers configures for the sensible cooling only mode.
Figure 11:
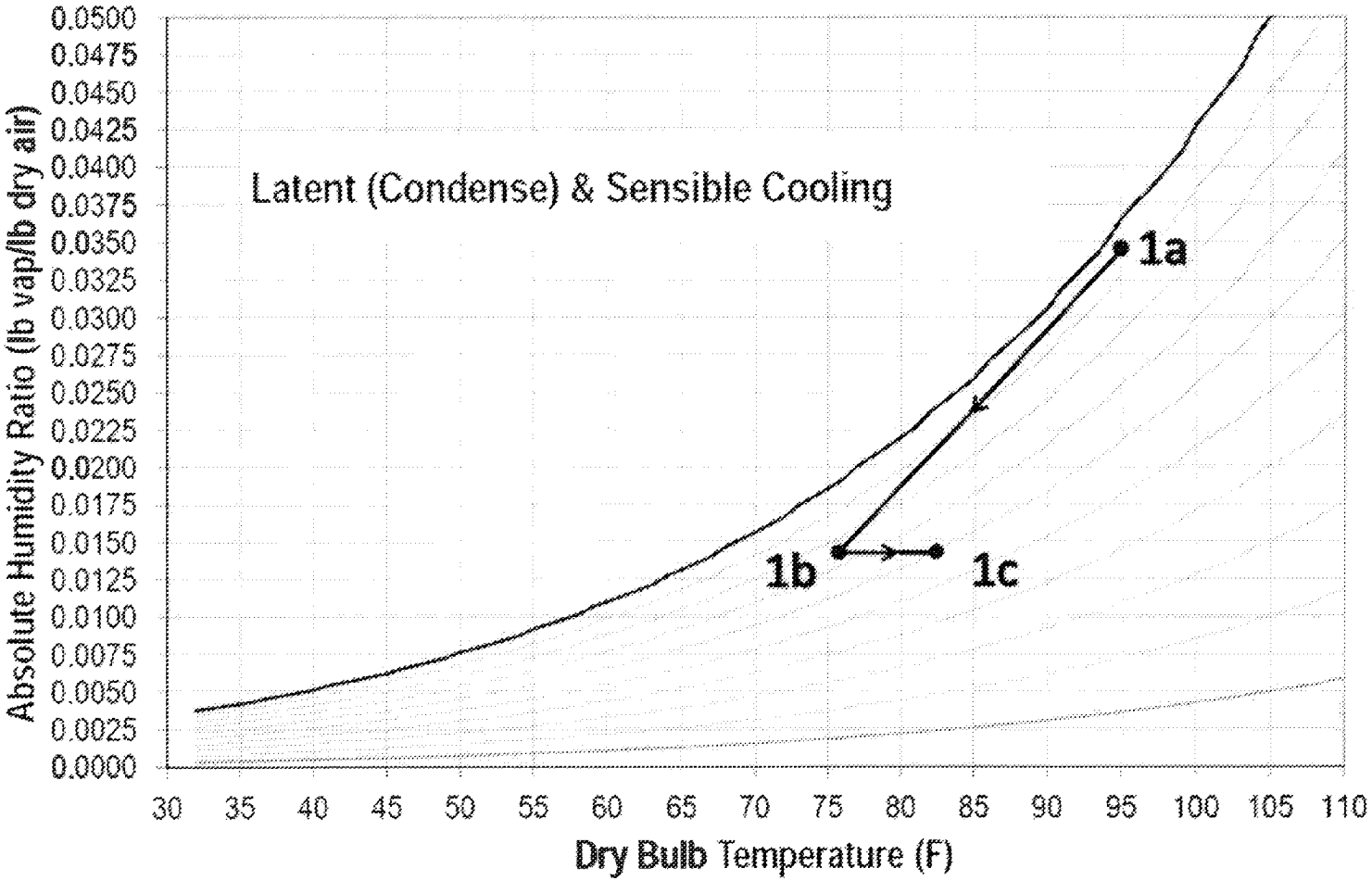
FIG. 11 is a chart of the combination mode showing latent cooling and sensible cooling, with sensible reheat.

Looking now to FIGS. 5, 9 and 11, it is seen that a configuration for the combination cooling mode is illustrated. In this configuration, the cold working fluid first is routed in a counter-flow manner through heat exchanger 50, is then routed to the second heat exchanger 70 wherein it is also routed in a counter flow configuration. In this regard, the working fluid exits the first heat exchanger 50 warmer than the air exiting the first heat exchanger. The air is then rewarmed in the second heat exchanger 70 by transferring the heat from the warmer fluid back to the cooler air. This is seen in FIG. 11 wherein there is latent cooling and sensible reheating. In this regard, it is seen that both temperature and absolute humidity ratio are reduced in the latent heat exchanger 50 along the line from point 1*a* to point 1*b*. In the second heat exchanger 70, the temperature of the air actually rises while the absolute humidity ration remains unchanged. In this regard, the air is conditioned to be far away from the dew point as illustrated in the line from point 1*b* to point 1*c*. It is appreciated that the rewarming of the air is accomplished without adding additional energy to the system.

Figure 8:
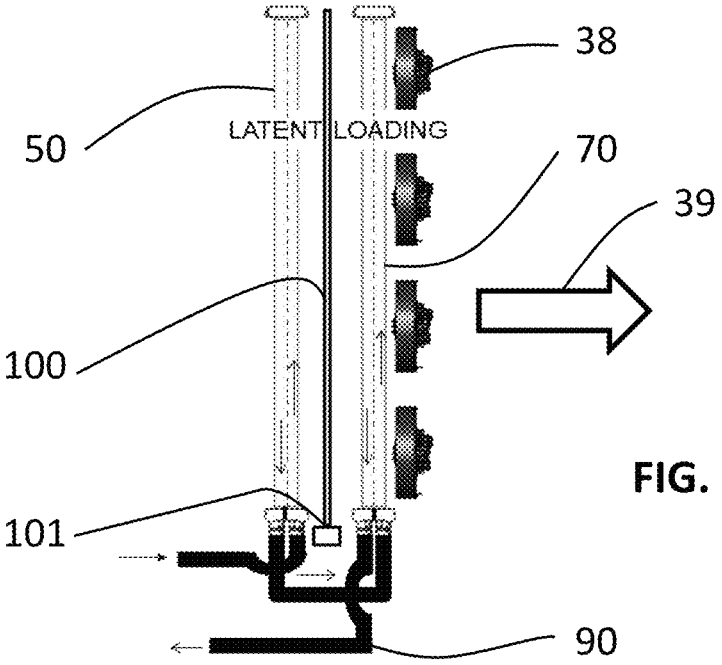
FIG. 8 is similar to FIG. 5, but includes an optional preferred coalescing screen between the two heat exchangers.

An alternative embodiment including a coalescing screen 100 with a catch basin 101 is shown in FIG. 8. In this illustrated embodiment, the coalescing screen is a structure that can collect condensate and allow for the water to fall into a basin 101. The basin can then be drained to remove the water from the system.

Figure 6:
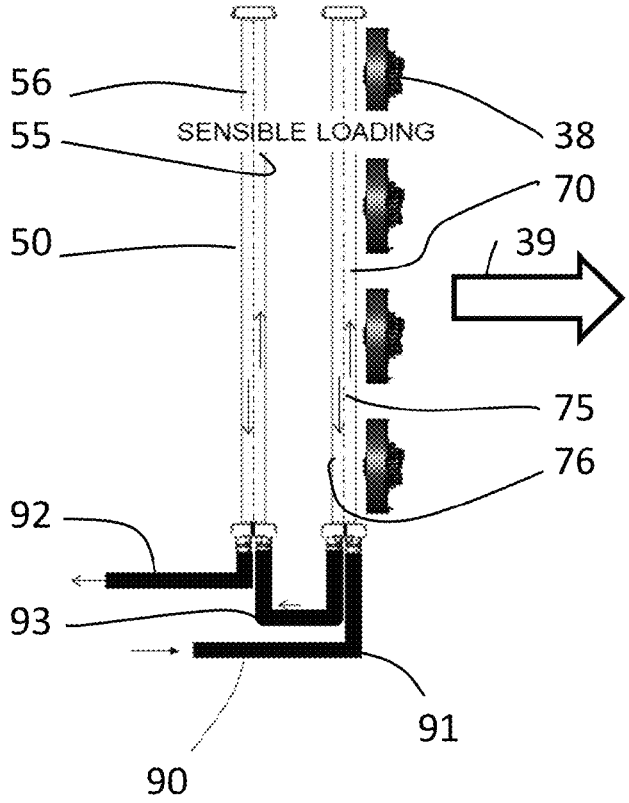
FIG. 6 is a side view of preferred heat exchangers of the present invention illustrating routing for a sensible cooling only mode.
Figure 12:
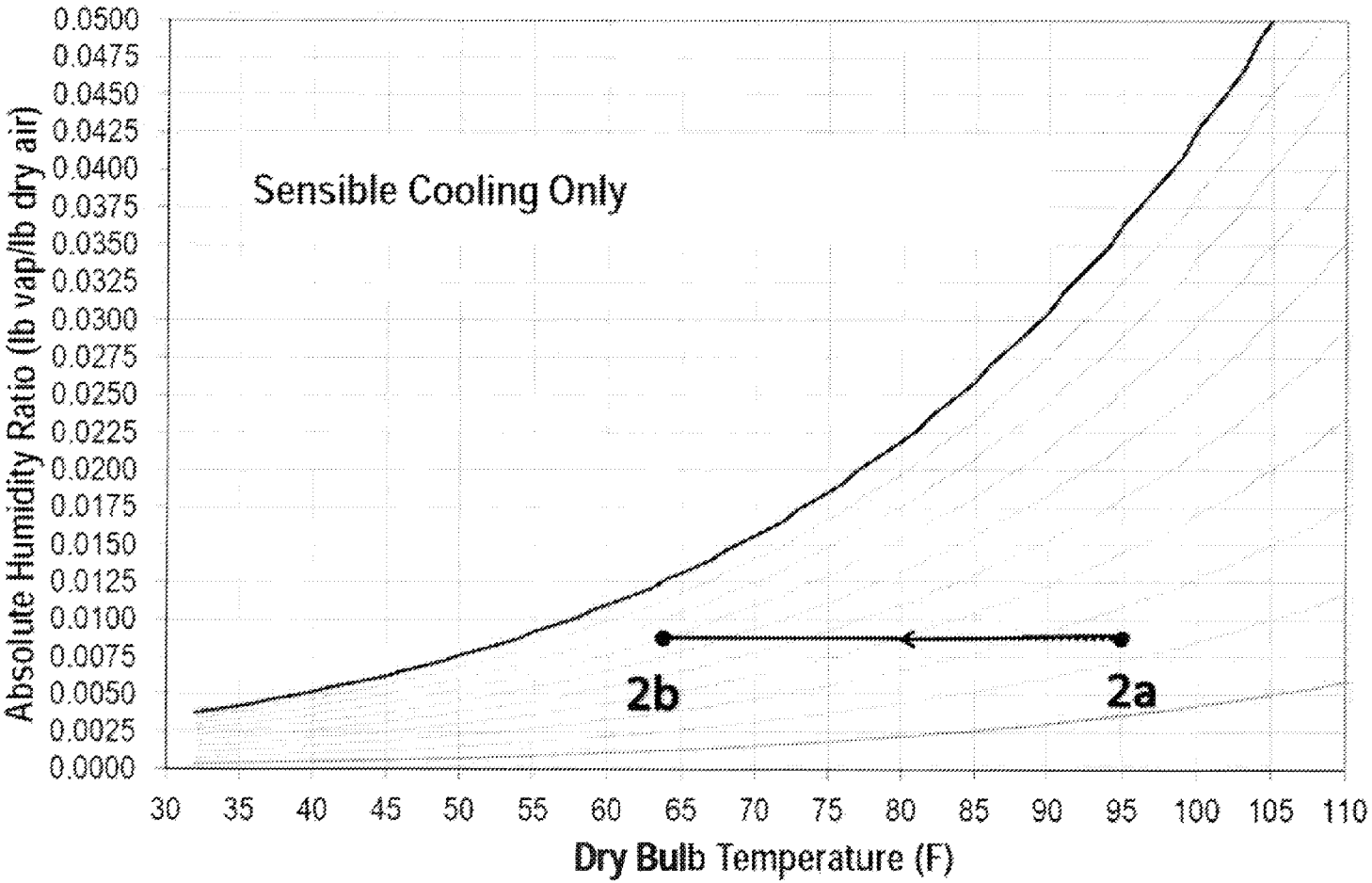
FIG. 12 is a chart of the sensible only mode showing sensible cooling only.

Looking now to FIGS. 6, 10 and 12, it is seen that a configuration for the sensible cooling only mode is illustrated. In this configuration, the cold working fluid first is routed in a counter-flow manner through heat exchanger 70, is then routed to the first heat exchanger 50 wherein it is also routed in a counter flow configuration. In this regard, the working fluid is cooler in the second heat exchanger 70 and warmer in the first heat exchanger 50 (after having already passed through the second heat exchanger). An example of this type of cooling is illustrated in FIG. 12, wherein it is seen that the temperature is reduced while the absolute humidity ration remains largely unchanged. This is illustrated in FIG. 12 as the line from point 2*a* to point 2*b*.

It is appreciated that another mode, namely a latent cooling only mode, could be incorporated into the present invention without departing from the broad aspects of the present invention. In a latent cooling only mode, the working fluid could either be routed to a single heat exchanger or routed to both heat exchangers in parallel (instead of series).

One working fluid is preferably water. Water is preferably used since has a wide operation range without a phase change, is non-toxic and is commonly available. It is preferred that the water can have an incoming temperature of 32 degrees or above.

Aluminum heat exchangers are used in one embodiment of the present invention. When aluminum is used, a preferred working fluid is inhibited water.

While water is described herein to be a preferred working fluid, it is appreciated that the present invention is not so limited. In this regard, other working fluids may be utilized without departing from the broad aspects of the present invention.

Thus it is apparent that there has been provided, in accordance with the invention, a multi-mode thermal management assembly with selectable coolant flow path that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as they fall within the spirit and broad scope of the appended claims.

I claim:

1. A thermal management assembly that is a single assembly and comprising:

at least one module, said at least one module having an inlet, an outlet, a first side panel, a second side panel, a first heat exchanger and a second heat exchanger; and plumbing, wherein:

an air flow path extends from said inlet to said outlet, said air flow path being between said first side panel and said second side panel;

said first heat exchanger is between said first side panel and said second side panel, said first heat exchanger circulating a working fluid there through, said working fluid being a single phase working fluid, said first heat exchanger having a first heat exchanger first side, a first heat exchanger second side, a first heat exchanger first header with a first heat exchanger first header partition separating said first heat exchanger first header into a first heat exchanger first header first side and a first heat exchanger first header second side, and a first heat exchanger second header, wherein:

said first heat exchanger first side is upstream of said first heat exchanger second side relative to said air flow path, and said working fluid passes through said first heat exchanger in a first heat exchanger counter flow path relative to said air flow path, wherein said working fluid in said first heat exchanger counter flow path:

enters said first heat exchanger in said first heat exchanger first header second side;

passes completely through a first heat exchanger first path that is adjacent to said first heat exchanger second side;

passes through said first heat exchanger second header;

passes completely through a first heat exchanger second path that is adjacent to said first heat exchanger first side; and passes through said first heat exchanger first header first side to exit said first heat exchanger; and said second heat exchanger is between said first side panel and said second side panel, said second heat exchanger being in a series arrangement with said first heat exchanger and downstream of said first heat exchanger relative to said air flow path, said second heat exchanger circulating said working fluid there through, said second heat exchanger having a second heat exchanger first side, a second heat exchanger second side, a second heat exchanger first header with a second heat exchanger first header partition separating said second heat exchanger first header into a second heat exchanger first header first side and a second heat exchanger first header second side, and a second heat exchanger second header, wherein:

said second heat exchanger first side is upstream of said second heat exchanger second side relative to said air flow path, said working fluid passes through said second heat exchanger in a second heat exchanger counter flow path relative to said air flow path, wherein said working fluid in said second heat exchanger counter flow path:

enters said second heat exchanger in said second heat exchanger first header second side;

passes completely through a second heat exchanger first path that is adjacent to said second heat exchanger second side;

passes through said second heat exchanger second header;

passes completely through a second heat exchanger second path that is adjacent to said second heat exchanger first side; and passes through said second heat exchanger first header first side to exit said second heat exchanger; and said plumbing routing said working fluid in a first condition first to said first heat exchanger and then to said second heat exchanger, or in a second condition first to said second heat exchanger and then to said first heat exchanger, wherein said first heat exchanger counter flow path and said second heat exchanger counter flow path is maintained in both of said first condition and said second condition.

2. The thermal management assembly of claim 1 wherein said first heat exchanger is vertically aligned.

3. The thermal management assembly of claim 1 wherein:

said first heat exchanger has a heat exchanger top and a heat exchanger bottom; and said working fluid enters said first heat exchanger first path at said heat exchanger bottom.

4. The thermal management assembly of claim 3 wherein said working fluid exits said first heat exchanger second path at said heat exchanger bottom.

5. The thermal management assembly of claim 1 wherein said working fluid is water and an inlet working fluid temperature is above 32 Degrees Fahrenheit.

6. The thermal management assembly of claim 1 wherein said at least one module further has at least one air mover to force air through said first heat exchanger and said second heat exchanger.

7. The thermal management assembly of claim 1 further comprising a coalescing screen between said first heat exchanger and said second heat exchanger.

* * * * *